United States Patent [19]

Osmond et al.

[11] 4,002,436

[45] * Jan. 11, 1977

[54] POLYMER SOLUTION

[75] Inventors: Desmond Wilfrid John Osmond, Windsor; Norman Douglas Patrick Smith; Frederick Andrew Waite, both of Farnham Common, all of England

[73] Assignee: Imperial Chemical Industries Limited, London, England

[ * ] Notice: The portion of the term of this patent subsequent to Dec. 7, 1993, has been disclaimed.

[22] Filed: Apr. 11, 1973

[21] Appl. No.: 349,942

Related U.S. Application Data

[63] Continuation of Ser. No. 79,701, Oct. 9, 1970, abandoned.

[30] Foreign Application Priority Data

Oct. 10, 1969 United Kingdom ..... 49834/69

[52] U.S. Cl. ..... 44/62; 44/63; 44/70; 44/80

[51] Int. Cl.[2] ..... C10L 1/22

[58] Field of Search ..... 44/62, 70, 71, 7 E, 44/7 D, 7 C, 63, 80

[56] References Cited

UNITED STATES PATENTS

| | | | |
|---|---|---|---|
| 2,927,849 | 3/1960 | Greblick et al. | 44/7 D |
| 3,219,619 | 11/1965 | Dickerson | 44/7 C |
| 3,416,899 | 12/1968 | Schiff | 44/7 D |
| 3,460,921 | 8/1969 | Winkler | 44/7 D |
| 3,460,922 | 8/1969 | Winkler | 44/7 C |
| 3,542,531 | 11/1970 | Hiatt et al. | 44/7 D |

OTHER PUBLICATIONS

Def. Pub., 858 O.G. 724, T858,018, Published Jan. 21, 1969, Norman Jacobson.

*Primary Examiner*—Daniel E. Wyman
*Assistant Examiner*—Y. Harris-Smith
*Attorney, Agent, or Firm*—Cushman, Darby & Cushman

[57] ABSTRACT

The dissemination of gas turbine engine aviation fuels under shock conditions, particularly by forming mist particles, and the accompanying fire hazard, are reduced by dissolving in the fuel a soluble polymer of molecular weight greater than $10^6$ in such concentration that there is molecular overlap of the dissolved polymer in the fuel, the dissolved polymer being one containing polar groups which form bonds with each other when the fuel is subjected to shock.

5 Claims, No Drawings

POLYMER SOLUTION

This is a continuation of U.S. application Ser. No. 79,701 filed Oct. 9, 1970, now abandoned.

This invention relates to improved liquid hydrocarbon aircraft fuels.

Vapours of low flash point liquid hydrocarbon aircraft fuels, being readily ignited, are a major hazard under crash conditions. This hazard can be reduced to some extent by using liquid hydrocarbon fuels of flash point not less than 90° F. but even then, mists of such fuels which form when the liquid is subjected to conditions of shock are also readily ignitable.

In our earlier U.S. Pat. application Ser. No. 818,249, filed Apr. 22, 1969 we have described how the tendency of liquid hydrocarbon aircraft fuels to form mists when subjected to shock conditions can be reduced by dissolving in the fuel a polymer of molecular weight greater than $10^6$ (viscosity average) or of intrinsic viscosity greater than 2.5 dls./gm. in a concentration such that there is molecular overlap of the dissolved polymer. As, in that earlier Application, the term "molecular overlap" describes the condition in which the segment density of the dissolved polymer in the liquid is substantially uniform on a molecular scale and this condition corresponds to concentrations at and above that at which the centres of mass of the polymer molecules are spaced, on average, at twice the radius of gyration of the polymer molecules.

We have now found that in the fuels described and claimed in the earlier patent application, the tendency to misting can be further reduced if the dissolved polymer contains polar groups which form inter-molecular associative bonds with each other when the liquid is subjected to shear. The intermolecular associative bonds are believed to reduce the breakdown into droplets and the consequent formation of mist.

At low concentrations of polar groups in the fuel it is still a free-flowing liquid under low shear conditions and it is believed that it is only under conditions of high shear arising when it is subjected to shock that a highly crosslinked structure resulting from inter-molecular association is formed. However, as the concentration of polar groups in the fuel is increased more inter-molecular associations are present even at low shear conditions and at the higher concentrations of polar groups employed in this invention the liquid begins to exhibit some indications of slight gel structure even at low shear. A further increase in concentration of polar groups in the fuel then results in it exhibiting a gel structure as described and claimed in our other earlier U.S. patent application Ser. No. 737,395, now abandoned, but the present invention does not extend to the gelled fuels of that other earlier patent application. In a preferred form of the present invention the fuel is a free-flowing liquid under low shear conditions.

In a test described in U.S. patent application Ser. No. 737,395 now abandoned an open-ended, internally-smooth cylinder 20 cm. in diameter and 20 cm. in height is stood on a flat plate, the lower open end of the cylinder forming a seal with the plate. The cylinder is then filled with the gelled liquid under test. After allowing the liquid to stand for sufficient time for the gel structure to reform, the cylinder is lifted vertically to leave the mass of gelled liquid standing unsupported on the plate. This unsupported mass will sag and spread out over the plate. If the mass spreads to such an extent that the resulting layer is only a millimetre or less in average thickness then the liquid is a free-flowing one.

By "associative bonds" we mean bonds arising from electrostatic attraction between mono-polar and/or di-polar charges in the polar groups, these bonds being ones which can be broken and re-made without changing the nature of the polar groups. We specifically exclude co-valent bonds which result from a sharing of electron orbits between polar groups.

The bond energy between the groups should be at least that corresponding to the energy of hydrogen bonds formed in the hydrocarbon liquid between —OH groups of ROH reacting with —O— groups of ROR′, where R and R′ are alkyl. The bond energy should not be comparable with and certainly must not be greater than that of a typical C—C co-valent bond. The hydrocarbon liquid may contain a small proportion of other liquids, such as ethers, esters, ketones and nitro-paraffins, particularly when the energy of the associative bond in the hydrocarbon liquid would otherwise be higher than the minimum stated above. However, since the nature of the liquid has an effect on the associative bond energy of any particular pair of group arrangements, the energy decreasing as the polarity of the liquid increases, the hydrocarbon liquids to which this invention is to be applied should not contain a substantial proportion of a miscible protolytic liquid such as methanol.

The polar groups may associatively bond with like groups in the same type of polymer or the associative bonding may be between pairs of complementary interacting polar groups, the complementary groups preferably each being in different polymers which are blended in the liquid. The different polymers must, of course, be compatible in the liquid to provide a homogeneous solution.

Suitable polar groups for associatively crosslinking the polymer structure are those which provide hydrogen bonds and bonds resulting from interaction between monopoles such as ions or between strong dipoles such as those provided by nitrile, nitro, sulphone, aromatic residues substituted with these groups and ion pairs.

Suitable hydrogen bonds are, for example, those between hydroxyl, carboxyl, amine, amide, ureido, urethane and mercaptan groups, either between one type only or between two types of these groups, and between one of these groups and an ester or ether oxygen or thio ether group or a tertiary base.

Suitable bonds beween strong dipoles provided by ion pairs include those between Zwitter ions, such as betaines and sulpho-betaines, quaternary ammonium salts and sodium or other metal salts of acids.

Suitable bonds between ions are those between quaternary bases and acid groups such as carboxylic, sulphonic, phosphonic acid and sulphate half-esters and phosphate esters, between amines and sulphonic or phosponic acids and between polyvalent metal ions, such as Ca, Mg and Al and acid groups. Associative bonds between such ions are strong and those between for example quaternary ammonium bases and sulphonic or sulphuric half-ester acids represent the strongest which can be used in application of this invention.

With respect to the polar groups the polymers must have an average number functionality of greater than 10, i.e. each polymer molecule must contain on average more than 10 polar groups. In general, the weaker the bond energy of the polar groups or the greater the molecular weight of the polymer, the higher should be the functionality of the polymer; preferably it is greater than 100.

Preferably, the polar groups are relatively oleophilic, by this we mean that when the group is present in a compound of the formula $CH_3X$, where X represents the polar group, the compound is not miscible in all proportions with water at room temperature.

The proportion of polymer used is suitably in the range 0.01–1% by weight of the liquid fuel.

The basic requirement is that the concentration of polymer is at least that required for molecular overlap and this may be determined by a test in which the viscosity of a range of solutions of polymer in the fuel is measured on a cone and plate or concentric cylinder viscometer (e.g. a Weisenberg rheogoniometer or a Contraves Rheomat) at shear rates covering the range $20 - 20{,}000\ sec^{-1}$. In respect of each solution the viscosity is plotted against shear rate and the curve arbitrarily extrapolated at zero shear rate. The zero shear rate viscosities are then plotted against concentration on log/log scales. The log/log scales when plotted for closely spaced concentrations show an upturn at which abnormal viscosity begins to occur. Suitable polymer concentrations to use in the modified fuels are from 1–10 times the proportion at which this upturn occurs and preferably from 1.5–5 times the proportion at which this upturn occurs.

In this test it is, of course, necessary to eliminate during the determination of viscosity the inter-molecular associative bonds. This can be achieved by adding to the solution on which the determinations are carried out a low molecular weight alkyl compound which contains per molecule one polar group which interacts preferantially with the polar groups in the polymer molecule and thus blocks the tendency of the polar groups in the polymer to self-associate.

For example, where the inter-molecular associative bonds involve carboxy groups the low molecular weight compounds may be a fatty amine, the carboxyl groups then reactimg preferentially with the amine groups. Alternately, an alkanol such as methanol may be used but in this case because of the relatively low energy of the carboxyl hydroxyl bond a large stoichiometric excess of the alkanol is required. The low molecular weight compound must, of course, be soluble in the aircraft fuel used in the test.

The resistance of a solution to shock formation of droplets may also be determined by a simple test in which a 10 ml. sample of the modified fuel is dropped in a thin stream from a height of 2 metres into a hollow cylndrical vessel of diameter 17 cm. and height 21 cm. having its sides lined with absorbent paper. In order to facilitate observation a small quantity of soluble dye is added to the sample of fuel. The density and size of the spots produced on the paper by droplets splashed from the sample give an indication of its misting characteristics. The minimum polymer concentration at which there are substantially no spots on the absorbent paper is the minimum useful concentration and in aircraft fuels the polymer concentration should be in the range 1–10 times this minimum concentration, preferably from 1.5–5 times this concentration.

The concentration of polar groups in the liquid fuel should be in the range $10^{-7} - 10^{-4}$ gm. moles of group per gm. fuel. Where the bond energy between polar groups is relatively low, e.g. as between ester oxygen and carboxyl or hydroxyl groups, the concentration of groups in the fuel will usually be at the upper end of this range. When the bond energy between the groups is relatively high, e.g. as between strong dipoles, the concentration of groups in the fuel will usually be at the lower end of this range. With medium bond energies, e.g. as between carboxyl or hydroxyl groups or between carboxyl and amine groups, the concentration of groups will usually be around the central part of this range.

Even when metal ions are present in the polymers used in the composition of this invention the proportion of metal so introduced into the hydrocarbon is, due to the high efficiency of the polymer and its low metal content, very low and can be acceptable even in aircraft fuels.

The polymers used in this invention will generally be of the free-radical addition type since these are the simplest to make in the presence of polar groups.

For use in hydrocarbons of a mainly aliphatic nature suitable soluble polymers are those of long chain (i.e. greater than $C_5$) esters of unsaturated acids and of unsaturated alcohols, e.g. stearyl, lauryl, octyl, 2-ethyl hexyl and hexyl esters of acrylic or methacrylic acid and corresponding long chain acid esters of vinyl alcohol such as vinyl stearate, etc. A corresponding range of long chain (in this case greater than $C_3$) ethers of unsaturated alcohols, e.g. vinyl octa-decyl ether, may also be used as monomers. Also suitable are polymers of alkenes such as butadiene, isoprene and isobutylene, and non-crystalline polymers of ethylene and propylene.

For use in hydrocarbons of a mainly aromatic nature similar polymers may be used and, in addition, shorter chain analogues, e.g. polymers of ethoxy ethyl methacrylate, methyl methacrylate and ethyl acrylate. Other suitable polymers include those of vinyl benzenes such as styrene and vinyl toluene. The term "polymer" as used above includes copolymers; suitable polar groups in suitable proportions may be introduced into the polymer by use of a co-monomer containing such a group. Suitable co-monomers for introducing simple polar groups which are acidic include acrylic and methacrylic acids, maleic anhydride, vinyl sulphonic acid, vinyl phosphate and phosphonic esters of unsaturated OH-containing compounds such as the phosphonic ester of hydroxy isopropyl methacrylate.

Suitable co-monomers for introducing simple polar groups which are basic include vinyl pyridine, vinyl diethylamine, N,N-dimethylamino-ethyl methacrylate and tertiary butylamino-ethyl (meth)acrylate. Groups such as sulphones may be introduced by vinyl methyl sulphone. Strongly ionic and dipolar groups are preferably introduced after the polymer has been formed, e.g. by neutralization of acidic groups or quaternisation of basic groups.

Another class of addition polymers suitable for use in this invention are hydrocarbon polymers such as those derived from alkenes. Unfortunately the preparation of these usually involves ionic polymerisation and since the polar groups required in the final polymer may interfere with the ionic catalyst used in the polymerisation, it is usually necessary first to prepare the hydrocarbon polymer and then modify it to introduce the polar groups required for the associative bond. Suitable hydrocarbon polymers are non-crystalline polymers and copolymers derived from monomers such as ethylene, propylene, isobutylene, butadiene isoprene and other higher $\alpha$-alkalenes, e.g. petroleum feed stock alkenes. Alternatively, natural rubber and other synthetic rubbers may be used. These polymers are then modified to introduce the desired polar groups.

Where the hydrocarbon polymer contains residual unsaturation, polar groups can be introduced by addition reactions, e.g. by addition of thiols such as thioglycollic acid, aldehydes or halogen or by epoxidation. In some of these cases the groups so introduced may need further modification to provide the desired polar groups; for example, the halogen groups or the hydroxyl groups resulting from addition of aldehyde can be so modified. Alternatively, groups may be introduced by reaction of a carbene containing an appropriate group with unsaturated groups in the polymer. Where there is little or no residual unsaturation the desired polar groups may be introduced into the hydrocarbon polymer by substitution reactions, e.g. by halogenation, chlorosulphonation, chlor-carbonylation phosphorylation or maleinisation. Where the hydrocarbon polymer contains an aromatic ring, such as in a styrene copolymer, the desired polar group may be introduced through aromatic substitution by the classical routes.

The soluble polymer used in this invention may, as a further alternative to an addition polymer, be a condensation polymer such as a polyester or aliphatic polyether, provided its molecular weight is high enough.

The polymer must be soluble in the fuel and in general the solubility in the liquid hydrocarbon fuel of the polymer devoid of the interacting polar groups should be such that the theta-temperature of the system is below the temperature to which the solution is likely to be subjected, otherwise there is a danger of precipitation of the polymer. The polymer-solvent relationship at the theta-temperature is discussed by P. J. Flory in "Principles of Polymer Chemistry" at pages 612–615. In jet aircraft the lowest temperature to which the fuel is likely to be subjected is about −50° C.

Suitable liquid hydrocarbon fuels of flash point at least 90° F. to which this invention may be applied include aviation turbine fuels Grade JP-8 (flash point 110° F. min.) as specified in U. S. Military Specification MIL-T-83133, Grade JP-5 (flash point 140° F. min.) as specified in U. S. Military Specification MIL-T-5624G, Grades Jet A and Jet A-1 (flash point 110° F. min.) as specified in ASTM Specification D.1655/66T and Grade AVTUR - NATO Code No. F-35 (flash point 100° F. min.) as specified in U. K. Ministry of Aviation Specification No. D. Eng. R. D. 2494 (Issue 4).

In a preferred form of the invention the viscosity of the liquid hydrocarbon fuels is improved by the addition of the soluble polymer containing polar groups is less than 10 poises at zero shear rate at ambient temperature. Viscosity at zero shear rate is determined by measuring on a cone and plate or concentric cylinder viscometer the viscosity of the improved fuel at shear rate covering the range 20–20,000 sec. $^{-1}$, plotting viscosity against shear rate and extrapolating the plot to zero shear rate. As a further preference the viscosity of the improved fuel at zero rate is less than 1.0 poise.

The invention is illustrated by the following Examples in which all proportions and percentages are by weight.

EXAMPLE 1

A mixture of 64 parts of water, 16 parts of acetone, 19 parts of 2-ethyl hexyl acrylate, 1 part acrylic acid and 0.5 part of Manoxolot (sodium dioctyl sulpho succinate) is stirred and heated to 70° C. under nitrogen for 5 minutes. The mixture is then cooled to 180° C. in cooling bath and a solution of 0.02 part of ammonium persulphate in 0.8 part of water is added, followed by an addition of a solution of 0.03 part of sodium dithionite in 0.8 part water. The temperature rises to about 28° C. in 5–10 minutes and then subsides. The mixture is stirred for one hour then filtered through muslin to give a 20% solids dispersion of a copolymer of 2-ethyl hexyl acrylate and acrylic acid, 95:5.

98 parts of aviation kerosene (Avtur) is heated to 160° C. and 10 parts of the aqueous dispersion prepared by the method described above is added dropwise during 30 minutes, the water being simultaneously removed by azotropic distillation. On cooling, a 2% solution of the acrylic copolymer in Avtur is obtained. The solution exhibits a gel-like structure but on dilution with Avtur gives free-flowing liquids which exhibit mist/fire suppression behavior at concentrations as low as 0.1%.

EXAMPLES 2–13

Polymers prepared by the method of Example 1 are listed in Column 1, composition by weight in Column 2, temperature of polymerisation in Column 3, molecular weight (or I.V.) in Column 4, and give mist/fire suppression behaviour at concentrations listed in Column 5 when dissolved in Avtur by the method of Example 1.

| Ex. | 1 | 2 | 3 | 4 | 5 |
|---|---|---|---|---|---|
| 2 | 2-EHA AA | 95:5 | 0–5° C. | $3\times10^6$ | 0.01% |
| 3 | 2-EHA AA | 93:7 | 30–35° C. | $1\times10^6$ | 0.2% |
| 4 | 2-EHA AA | 98:2 | 0–5° C. | $3\times10^6$ | 0.05% |
| 5 | 2-EHA AA | 99:1 | 0–5° C. | $3\times10^6$ | 0.1% |
| 6 | 2-EHA AA | 99.5:0/5 | 0–5° C. | $3\times10^6$ | 0.1% |
| 7 | 2-EHA AN | 90:10 | 20–25° C. | $1\times10^6$ | 0.15% |
| 8 | 2-EHA AN | 85:15 | 20–25° C. | $1\times10^6$ | 0.15% |
| 9 | 2-EHA AN | 98:2 | 20–25° C. | $1\times10^6$ | 0.5% |
| 10 | 2-EHA HEMA | 95:5 | 20–25° C. | $1\times10^6$ | 0.5% |
| 11 | Alphol MA AA | 95:5 | 20–25° C. | $1\times10^6$ | 0.2% |
| 12 | Vinyl octoate AA | 95:5 | 20–25° C. | $1.5\times10^6$ | 0.2% |
| 13 | Vinyl iso-butylene ether AA | 95:5 | 20–25° C. | $1.5\times10^6$ | 0.2% |

NOTE:
2-EHA AA = 2-ethyl hexyl acrylate acrylic acid.
AN = Acrylonitrile
HEMA = Hydroxyethyl methacrylate
Alphol MA = $C_{12-14}$ alkyl methacrylate

EXAMPLE 14

Polystyrene ($\overline{M}v$ 2,000,000) is alkylated with octene-1 using boron trifluoride as catalyst to give a polymer carrying on average 1.2 octyl chains per styrene residue. The resulting polymer is dissolved in a high boiling aliphatic hydrocarbon (boiling range 150°–200° C.) at 2% concentration and treated with 100% oleum at 0° C. in order to introduce sulphonic acid groups into the polymer to give a C:S ratio of 99.9:0.1 by weight. The resulting solution when diluted with Avtur has fire suppression characteristics at polymer concentrations as low as 0.2%. Treatment of the solution with sodium methoxide gives the sodium salt of the polymer which is effective at concentrations as low as 0.15% by weight.

EXAMPLE 15

A copolymer of 95 parts of 2-ethyl hexyl acrylate and 5 parts of vinyl pyridine is prepared by the method of Example 1 excepting that the polymerisation takes place in the presence of an additional surfactant, Tergitol N.P.A.O. The polymer of molecular weight $1 \times 10^6$ is dissolved in Avtur by the method of Example 1 to give a 2% solution of polymer.

When solutions of this amine-containing polymer, at the same concentration as any of the above-mentioned acid-containing polymer solutions, are blended with the acid-containing polymer solutions in ratios 1:10 to 1:1 by weight, the performance of the acid-containing polymer solution is improved as a result of interaction of the amine and acid groups.

EXAMPLE 16

A mixture of 0.2 part propane sultone and 100 parts of the 2% polymer solution in Avtur described in Example 15 is heated at 120° C. for two hours. The resulting solution exhibits a gel-like structure and on dilution with Avtur gives free-flowing liquids which exhibit mist/fire suppression characteristics at polymer concentrations as low as 0.2%.

EXAMPLE 17

When in Example 16 the propane sultone is replaced with $\beta$-propiolactone, polymer solution with similar characteristics are produced.

EXAMPLE 18

When in Example 16 the propane sultone is replaced with benzyl chloride polymer solutions with similar characteristics are produced.

EXAMPLE 19

A polymer solution with Avtur is prepared from 2-ethyl hexyl acrylate and vinyl chlor-acetate by the method of Example 1 to produce a polymer of molecular weight $1 \times 10^6$. 100 parts of the solution is mixed with 1 part of triethylamine and heated to 50° C. for 1 hour. The resulting polymer solution, when diluted with Avtur to 0.5%, still remained mist/fire suppression characteristics.

EXAMPLE 20

A solution comprising a copolymer of 99.5 parts of 2-ethyl hexyl acrylate and 0.5 part glycidyl acrylate of molecular weight $2 \times 10^6$ is prepared by the methods of Example 1. On treatment with a mole equivalent (for the glycidyl acrylate) of sulphuric acid or phosphoric acid polymer solutions are obtained which have mist/fire suppression characteristics at concentrations as low as 0.2%. Treatment of these solutions with an equivalent weight of calcium octoate, to produce the calcium salt, gives polymer solutions with improved mist/fire suppression characteristics.

What we claim is:

1. A liquid hydrocarbon jet aviation fuel of flash point at least 90° F suitable for use in gas turbine engined aircraft, and having a reduced tendency to particulate dissemination on being subjected to shock, the fuel containing dissolved therein 0.01 to 1% by weight of an addition polymer of ethylenically unsaturated monomer which is soluble in said hydrocarbon fuel of molecular weight greater than $10^6$ (viscosity average) or of intrinsic viscosity greater than 2.5 dls./gm. in a concentration such that there is molecular overlap of the polymer molecules in the liquid but the viscosity is less than 1 poise at zero shear rate at ambient temperature, the dissolved polymer containing polar groups which form inter-molecular associative bonds arising from electrostatic attraction between polar and/or dipolar charges in the polar groups, the bonds being hydrogen or electrovalent bonds.

2. A fuel as claimed in claim 1 in which the average number functionality of the polymer with respect to the polar groups is greater than 10.

3. A fuel as claimed in claim 1 in which the functionality is greater than 100.

4. A fuel as claimed in claim 1 in which the concentration of polar groups is from $10^{-7}$ to $10^{-4}$ gm. moles of group per gm. fuel.

5. A fuel as claimed in claim 1 in which the polar groups are relatively oleophilic in that when present in a compound of the formula $CH_3X$, where X represents the polar group, the compound is not miscible in all proportions with water at room temperature.

* * * * *